US007153374B2

(12) United States Patent
Kikawa et al.

(10) Patent No.: US 7,153,374 B2
(45) Date of Patent: Dec. 26, 2006

(54) MAGNESIUM ALLOY

(75) Inventors: Kazuo Kikawa, Saitama (JP); Takashi Shiraishi, Saitama (JP); Atsushi Fukatsu, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 254 days.

(21) Appl. No.: 10/381,781

(22) PCT Filed: Aug. 9, 2002

(86) PCT No.: PCT/JP02/08158

§ 371 (c)(1),
(2), (4) Date: Mar. 28, 2003

(87) PCT Pub. No.: WO03/016581

PCT Pub. Date: Feb. 27, 2003

(65) Prior Publication Data

US 2004/0045639 A1 Mar. 11, 2004

(30) Foreign Application Priority Data

| | | |
|---|---|---|
| Aug. 13, 2001 | (JP) | 2001-245557 |
| Aug. 13, 2001 | (JP) | 2001-245558 |
| Aug. 13, 2001 | (JP) | 2001-245559 |
| Aug. 13, 2001 | (JP) | 2001-245560 |
| Jul. 11, 2002 | (JP) | 2002-202932 |
| Jul. 11, 2002 | (JP) | 2002-202933 |
| Jul. 11, 2002 | (JP) | 2002-202934 |

(51) Int. Cl.
*C22C 23/00* (2006.01)

(52) U.S. Cl. ..... 148/420; 420/405; 420/406

(58) Field of Classification Search ..... 148/420; 420/405, 406
See application file for complete search history.

(56) References Cited

U.S. PATENT DOCUMENTS 4,401,621 A 8/1983 Unsworth et al.

FOREIGN PATENT DOCUMENTS

| | | |
|---|---|---|
| EP | 0 799 901 A1 | 4/1997 |
| JP | 57-210946 | 12/1982 |
| JP | 61-250144 | 11/1986 |
| JP | 06-025790 | 2/1994 |
| JP | 06-049579 | 2/1994 |
| JP | 06-049580 | 2/1994 |
| JP | 06-172909 | 6/1994 |

(Continued)

*Primary Examiner*—Sikyin Ip
(74) *Attorney, Agent, or Firm*—Arent Fox PLLC

(57) ABSTRACT

A refractory magnesium alloy includes magnesium as a principal ingredient, and an element having a radius 9–14% larger than a magnesium atom and a maximum concentration of 2 mass % or larger in a solid solution with magnesium is mixed in an amount not exceeding a maximum amount that can be homogeneously mixed in the solid solution with magnesium, whereby internal strength of grains thereof is enhanced. Alternatively, gadolinium with a content thereof ranging from 0.5 to 3.8 mass % is added, so that remaining part other than the gadolinium is composed of the magnesium and unavoidable impurities. This magnesium alloy serves to inhibit decrease in proof stress and creep deformation, especially primary creep deformation when used at high temperatures, typically at 200° C. The magnesium alloy may be employed for a structural material for a vehicle, so that a lightweight and heat-resistant structural material can be obtained.

2 Claims, 8 Drawing Sheets

FOREIGN PATENT DOCUMENTS

| | | |
|---|---|---|
| JP | 06-200348 | 7/1994 |
| JP | 06-200350 | 7/1994 |
| JP | 08-269609 | 10/1996 |
| JP | 09-263871 | 10/1997 |
| JP | 09-263871 A | 10/1997 |
| JP | 9-272945 | 10/1997 |
| WO | 98/00456 | 1/1998 |

①RELATIONSHIP BETWEEN DIFFERENCE OF ATOMIC RADIUS AND AMOUNT OF INCREASE IN HARDNESS

| ELEMENT | DIFFERENCE OF ATOMIC RADIUS % | HARDNESS 200°C Hv |
|---|---|---|
| Al | −10.6 | 19.5 |
| Ca | 23.1 | 34.6 |
| Zn | −16.9 | 24.6 |
| Ga | −22.5 | 22.9 |
| Bi | −3.1 | 23.9 |
| Sn | −11.9 | 22.0 |
| Y | 13.8 | 54.1 |
| Nd | 13.8 | 39.2 |
| Sm | 11.9 | 33.8 |
| Gd | 11.3 | 65.5 |

②RELATIONSHIP BETWEEN MAXIMUM AMOUNT CAPABLE OF BEIHG MIXED IN SOLID SOLUTION AND AMOUNT OF INCREASE IN HARDNESS

| ELEMENT | MAXIMUM AMOUNT CAPABLE OF BEING MIXED IN SOLID SOLUTION 200°C mass% | HARDNESS 200°C Hv |
|---|---|---|
| Mg | – | – |
| Al | 3.32 | 19.5 |
| Ca | 0.18 | 34.6 |
| Mn | 0.11 | 0.0 |
| Zn | 1.86 | 24.6 |
| Ga | 0.86 | 22.9 |
| Pb | 3.31 | 23.9 |
| Bi | 0.09 | 23.9 |
| Zr | 0.30 | 0.0 |
| Sn | 0.49 | 22.0 |
| Y | 2.20 | 54.1 |
| Nd | 0.12 | 39.2 |
| Sm | 0.39 | 33.8 |
| Gd | 3.82 | 65.5 |

③RELATIONSHIP BETWEEN MAXIMUM AMOUNT CAPABLE OF BEIHG MIXED IN SOLID SOLUTION AND DIFFERENCE OF ATOMIC RADIUS

| ELEMENT | DIFFERENCE OF ATOMIC RADIUS % | MAXIMUM AMOUNT CAPABLE OF BEING MIXED IN SOLID SOLUTION 200°C mass% |
|---|---|---|
| Li | −5.0 | 4.80 |
| Al | −10.6 | 3.32 |
| Ca | 23.1 | 0.18 |
| Ti | −8.1 | 0.02 |
| Mn | −30.0 | 0.11 |
| Cu | −20.0 | 0.02 |
| Zn | −16.9 | 1.86 |
| Ga | −22.5 | 0.86 |
| Zr | 1.3 | 0.30 |
| Ag | −10.0 | 0.88 |
| Sn | −11.9 | 0.49 |
| Pb | 10.0 | 3.31 |
| Bi | −3.1 | 0.09 |
| Th | 12.5 | 0.50 |
| Sc | 3.1 | 11.39 |
| Y | 13.8 | 2.20 |
| La | 17.5 | 0.01 |
| Ce | 14.4 | 0.04 |
| Pr | 14.4 | 0.17 |
| Nd | 13.8 | 0.12 |
| Sm | 11.9 | 0.39 |
| Eu | 24.4 | 0.004 |
| Gd | 11.3 | 3.82 |
| Tb | 10.0 | 9.00 |
| Dy | 9.4 | 10.20 |
| Ho | 9.4 | 11.73 |
| Er | 8.7 | 18.53 |
| Tm | 10.0 | 17.59 |
| Yb | 21.3 | 0.04 |
| Lu | 8.1 | 19.57 |

RELATIONSHIP BETWEEN Zr CONTENT AND GRAIN SIZE OF CRYSTAL

| Zr CONTENT mass% | GRAIN SIZE OF CRYSTAL μm |
|---|---|
| 0.0 | 100 |
| 0.2 | 60 |
| 0.4 | 40 |
| 0.6 | 25 |
| 0.8 | 20 |
| 1.0 | 20 |
| 1.2 | 20 |

MAGNESIUM ALLOY

TECHNICAL FIELD

This invention relates to magnesium alloys. More particularly, this invention relates to a magnesium alloy having high heat resistance and high creep strength that lends itself to structural materials used under high temperature conditions.

BACKGROUND ART

In recent years, out of consideration for the terrestrial environment, magnesium alloys (hereinafter referred to as "magnesium materials") are employed for reinforcements making up an engine, a frame, etc. of a vehicle, for purposes of enhancing fuel efficiency of the vehicle, for example.

The magnesium materials have been attracting attention as materials having a number of practically excellent properties in application for structural materials. To be more specific, magnesium is a metal material that is practically lightest in weight (e.g., specific gravity thereof is approximately two thirds of aluminum and approximately one fourth of iron), stronger and stiffer than iron and aluminum, having highest capability in absorbing vibrations (damping capacity) among practical metal materials, highly resistant to dint, less likely to undergo change in dimension with time or according to variation of temperature, and easily recyclable. For that reason, the magnesium material is suitable, in particular, for a structural material for vehicles, and for a housing of portable terminals.

However, in cases where a magnesium material is employed for a structural material of a vehicle or the like to be used in a high-temperature atmosphere, especially, when the magnesium material is employed for members making up an engine, which could be exposed to a high temperature approximating 200° C., an axial (tightening) force of a bolt, for example, would disadvantageously decrease in a portion where members are fastened with the bolt.

Decrease in axial force of the bolt in such a bolt-fastened portion may take place due to deformation of a fastened surface of the member or a nut, and it has been conceived that the decrease in axial force of the bolt would particularly depend upon the creep strength of the material.

As a result, in order to prevent the decrease in axial force of the bolt, various kinds of magnesium materials (magnesium alloys) having improved creep strength have been developed.

For example, a refractory magnesium alloy containing aluminum, zinc, or the like each in a specific proportion and formed by adding silica, rare-earth metal, calcium and the like is known in the art.

However, with a conventional magnesium alloy as above, though some improvement in creep strength can be achieved, it is difficult to check the decrease in axial force of the bolt on the condition that a member made up of the magnesium alloy is used in a relatively high-temperature atmosphere, and thus the aforementioned disadvantages cannot be deemed to be finally rooted up.

DISCLOSURE OF INVENTION

It is an object of the present invention to provide a magnesium alloy having high thermal resistance with which an axial force of a bolt does not decrease even when used under high temperature conditions, preferably at 150° C., and more preferably at 200° C., and a magnesium alloy having high creep strength which can prevent an axial force of a bolt from decreasing when a member such as of a structural material provided around an engine of a vehicle, or the like is used under high temperature conditions, preferably at 150° C., and more preferably at 200° C.

MODE(S) FOR CARRYING OUT THE INVENTION

Magnesium alloys according to the present invention includes first through third modes of magnesium alloys as will be described below. A detailed description will hereinafter be given of components of the first through third modes of the magnesium alloys according to the present invention.

The first through third modes of the magnesium alloys according to the present invention are magnesium-based alloys to which predetermined amounts of various components are added.

<Magnesium>

Magnesium is a base-metal element of the first through third modes of the present invention. Thus, the features of magnesium employed for a structural material will now be described. Hereupon, the term "magnesium material" will be used when general properties of magnesium as a structural material are explained in the following description.

As describe above, the magnesium material is practically most lightweight metal, stronger and stiffer than iron and aluminum, having highest capability in absorbing vibrations (damping capacity) among practical metal materials, highly resistant to dint, less likely to undergo change in dimension even in a high-temperature atmosphere, and easily recyclable.

However, when the magnesium material is exposed in a high-temperature atmosphere approximating 200° C., the magnesium material creeps, for example a bolt-fastened member made of magnesium material creeps, and an axial force of a bolt decreases.

Figure 1:
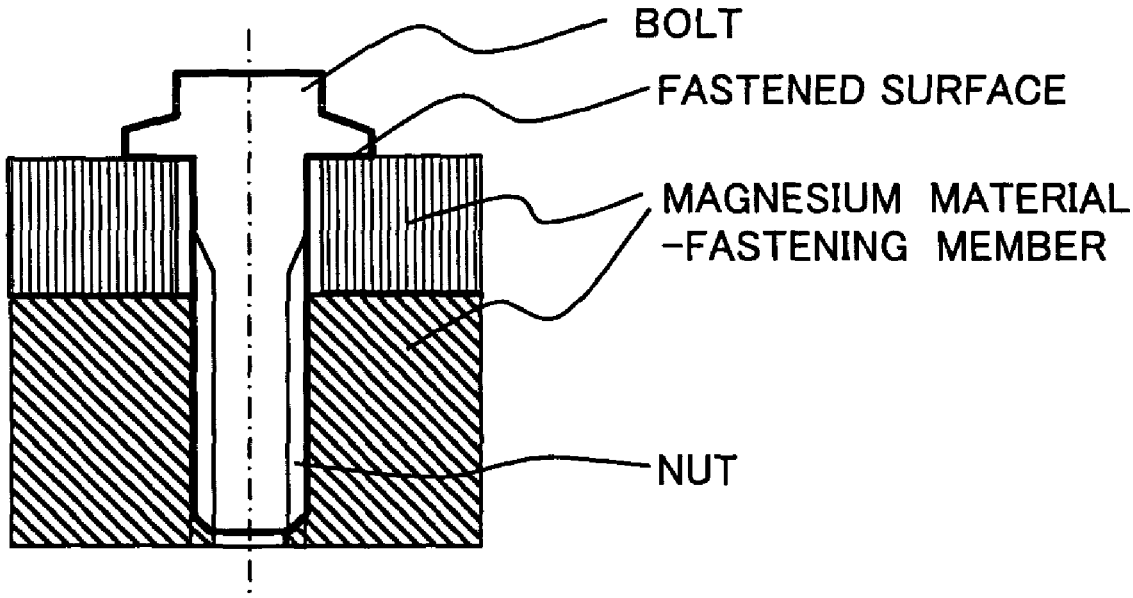
FIG. 1 is a schematic diagram for explaining a member fastened with a bolt which member is made of a magnesium material.

A change of the axial force of a bolt when a bolt-fastened member (FIG. 1) made of a magnesium material is exposed in a high-temperature atmosphere will now be described with reference to a graph (FIG. 2) showing a relationship between axial forces of the bolt and time.

When the bolt-fastened member is exposed in a high-temperature atmosphere, the axial force of the bolt rises, then drops sharply for a relatively short time, and subsequently decreases gradually. This phenomenon may presumably be attributable to the following reasons.

Immediately after the bolt is fastened to the member made of magnesium material, a stress applied to the fastened surface of the magnesium material and the nut is not more than a proof stress thereof, and thus the magnesium material has undergone no creep. Accordingly, the axial force of the bolt is retained at a sufficient level (RANGE a in FIG. 2).

When the bolt-fastened member made of magnesium material is exposed in a high-temperature atmosphere, the stress applied to the fastened surface of the magnesium material and the nut increases, while the strength of the magnesium material decreases due to increase in temperature.

Figure 2:
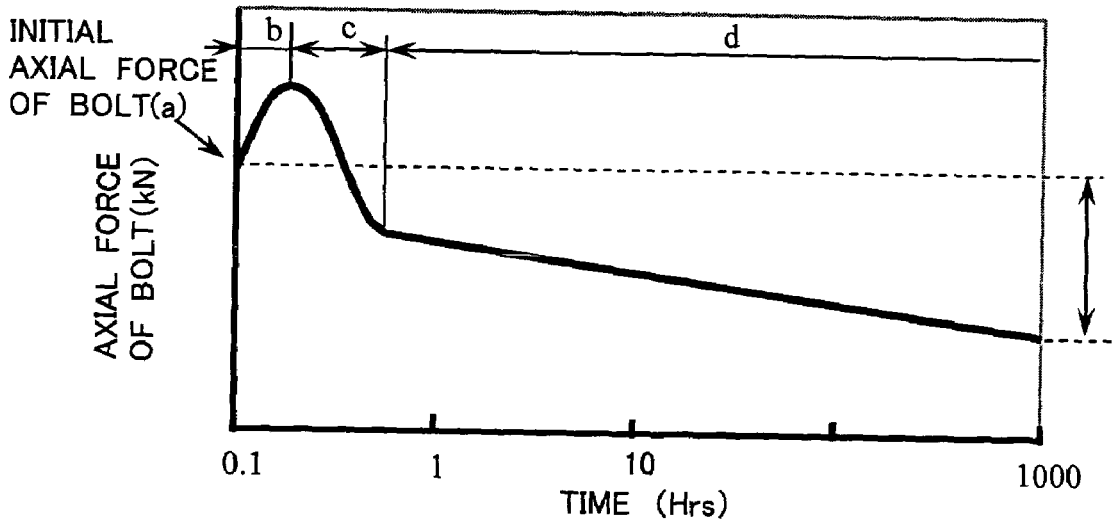
FIG. 2 is a graph showing a relationship between axial forces of a bolt and time, with the bolt-fastened member made of magnesium material exposed under high temperature conditions.

Immediately after the bolt-fastened member is exposed in a high-temperature atmosphere, the "thermal stress" generated due to a difference in thermal expansion amount between the magnesium material and the bolt material (FIG. 1; steel material) causes the axial force of the bolt to increase (RANGE b in FIG. 2).

Thereafter, when the stress applied to the fastened surface made of magnesium material and the nut exceeds the strength of the magnesium material, the magnesium material undergoes permanent deformation (creep) and the axial force of the bolt decreases (RANGE c in FIG. 2).

The decrease in axial force of the bolt goes on till the stress applied to the magnesium material reaches the proof stress or maximum level of strength durable of the magnesium material at that temperature.

When the stress applied to the magnesium material reaches the proof stress of the magnesium material at that temperature, the axial force of the bolt appears prevented from sharply decreasing, but thereafter steady-state creep deformation that appears under a lower stress causes a relatively gentle decrease in axial force of the bolt to progress (RANGE d in FIG. 2).

Next, a progress of creep deformation of a magnesium material will be described with reference to a graph (FIG. 3) showing a relationship between creep elongation of the magnesium material in a high-temperature atmosphere and time.

Figure 3:
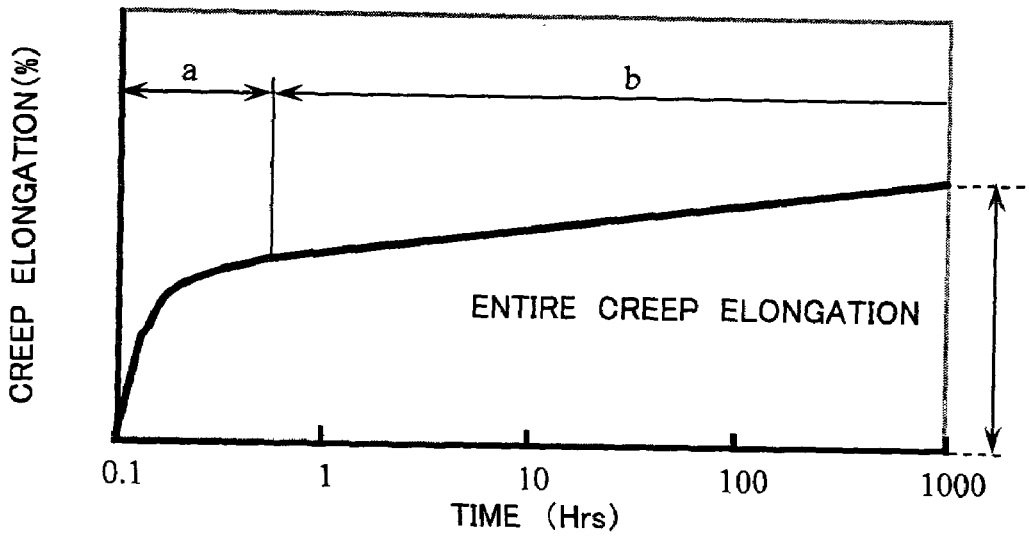
FIG. 3 is a graph showing a relationship between creep elongation and time with magnesium exposed under high temperature conditions.

When a magnesium material to which a specific level of stress is applied is exposed in a high-temperature atmosphere, a creep (elongation) appears within a relatively short time (RANGE a in FIG. 3). Such a creep will be hereinafter referred to "primary creep deformation". Thereafter, a relatively gentle creep (elongation) progresses, as time goes by (RANGE b in FIG. 3). Such a gentle creep will be hereinafter referred to as "steady-state creep deformation".

Subsequently, a description will be given of a mechanism that produces deformation as observed in a tensile test or a creep test.

Metal magnesium is a polycrystal that consists of aggregates of grains of magnesium. Grain boundaries exist between individual grains.

Since deformation is observed in individual grains of magnesium in the short-time range of the tensile test or creep test, it is assumed that the proof stress and primary creep deformation are subject to the strength of the grains.

On the other hand, since deformation is observed in grain boundaries of magnesium, and besides very small holes generate, in the long-time range of the creep test, it is assumed that the steady-state creep deformation is subject to the strength of the grain boundaries.

In the grains, there are atoms of magnesium that are regularly and three-dimensionally arranged. Such regular arrangement of magnesium atoms may easily be deformed by external forces. In principle, the deformation is mainly caused by dislocation of the atoms.

On the other hand, grain boundaries are portions that are formed in the last place during a manufacturing (casting) process, and elements other than magnesium and/or compounds incorporated in components of the metal magnesium are likely to be distributed therein. The grain boundaries, of which arrangement includes magnesium atoms and elements other than magnesium, suffer lattice defects caused by missing atoms in places. Under high temperature conditions, cohesive forces between atoms decrease due to increasing thermal vibrations. As a result, the atoms in the grain boundaries become likely to move to neighboring lattice defect portions more frequently. This phenomenon is called diffusion. As the diffusion progresses, grain boundaries deform.

To sum up the above, the decrease in axial force of a bolt in a bolt-fastened member made of magnesium material may be explained as follows. A sharp decrease in axial force of the bolt shown immediately after the bolt-fastened magnesium member is exposed under high temperature conditions results from the reduced proof stress and the primary creep deformation, which is subject to the internal strength of the grains, while a subsequent gradual decrease in axial force of the bolt results from the steady-state creep deformation, which is subject to the strength of the grain boundaries.

Accordingly, in order to inhibit the decrease in axial force of the bolt in the bolt-fastened member made of magnesium material for use under high temperature conditions, attempts should be made to improve the proof stress and to impede the primary creep deformation as well as to impede the steady-state creep deformation, because only such an attempt to impede creep deformation, particularly only an attempt to impede the steady-state creep deformation, as has been made in the conventional efforts to develop refractory alloys, could not prevent the axial force of the bolt from decreasing.

To improve the proof stress and impede the primary creep deformation, deformation in the individual grains of magnesium need be checked, whereas to impede the steady-state creep deformation, diffusion in the grain boundaries need be inhibited.

[First Mode]

A description will be given below of requirements for a first mode of magnesium alloys according to the present invention. The first mode of magnesium alloys according to the present invention is characterized by having an element (hereinafter referred to as "first component") in an amount not exceeding the maximum amount that can be homogeneously mixed in a solid solution with magnesium as described above which first component has a radius 9–14% larger than a magnesium atom and a maximum concentration of 2 mass % or larger in the solid solution, for the purposes of preventing the decrease of proof stress under high temperature conditions and the deformation derived from the primary creep (RANGE a in FIG. 2).

<First Component: an Element Having a Radius 9–14% Larger Than a Magnesium Atom, and a Maximum Concentration of 2 Mass % or Larger in a Solid Solution Mixed with Magnesium>

In the first mode of magnesium alloys according to the present invention, atoms of the first component homogeneously mixed with magnesium into a solid solution are partly substituted for atoms of magnesium in the grains to form a substitution solid solution, and thus a microscopic lattice distortion appears in crystals. Then, the microscopic lattice distortion serves to inhibit deformation in grains of magnesium which would appear when the magnesium is exposed in high temperature surroundings. As a result, the proof stress or tensile strength which is subject to the internal strength of the grains can be improved, and the primary creep deformation can be impeded.

It is a finding experimentally demonstrated by the present inventors and their colleagues that if the radius of atoms of the first component homogeneously mixed with magnesium into a solid solution is out of the range 9–14% larger than that of atoms of magnesium, the effect of improvement in the proof stress of the magnesium alloy can not sufficiently be achieved.

This is because of the diminished lattice distortion of a substitution solid solution obtained when the atomic radius of the first component to be homogeneously mixed with magnesium into a solid solution is smaller than the size 9% larger than the atomic radius of magnesium, which would lessen the effect of inhibiting deformation in grains.

Another reason therefor is as follows. The lattice distortion of the substitution solid solution obtained when the atomic radius of the first component to be homogeneously mixed into a solid solution exceeds the size 14% larger than the atomic radius of magnesium is large enough, but the amount of the first component mixed with magnesium would be so small that a solid solution could not readily be formed.

Further, if an element of which the atomic radius is smaller than that of magnesium is homogeneously mixed with magnesium into a solid solution, the intended effect of improvement in the proof stress can not sufficiently be achieved. This is based upon the same reason as in the case where the atomic radius of the element is smaller than the size 9% larger than that of magnesium as described above.

In actuality, when an element whose atomic radius is smaller than that of magnesium was homogeneously mixed with magnesium into a solid solution to form an alloy, the strength of the alloy conspicuously lowered by exposure of heat, and the effect of inhibiting deformation in grains was limited.

Figure 4:
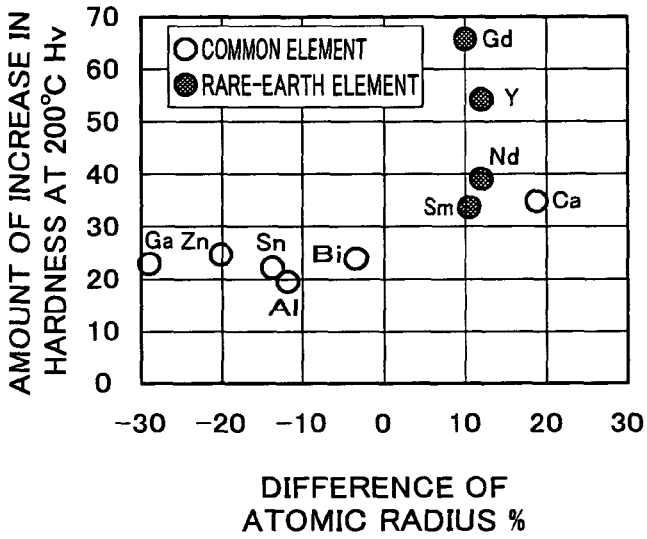
FIG. 4 is a diagram showing amounts of increase in hardness of alloys with respect to a difference between atomic radii of first components mixed with magnesium to be a solid solution, and the atomic radius of magnesium.

FIG. 4 shows increase in hardness of an alloy versus percentage of differences between experimentally obtained atomic radius of the first element homogeneously mixed with magnesium into a solid solution and the atomic radius of magnesium.

As apparent from FIG. 4, gadolinium (Gd) of which the atomic radius is 11.3% larger than that of magnesium exhibited an increase of 65.5 in hardness; among others, yttrium (Y) of which the atomic radius is 13.8% larger exhibited an increase of 54.1; neodymium (Nd) of which the atomic radius is 13.8% larger exhibited an increase of 39.2; and samarium (Sm) of which the atomic radius is 11.9% larger exhibited an increase of 33.8.

Among common elements of which the atomic radius is smaller than the size 9% larger than the atomic radius of magnesium, Bismuth (Bi) having an atomic radius of −3.1% larger exhibited an increase of 23.9 in hardness.

As described above, if the atomic radius of the first component falls within a range 9–14% larger than the atomic radius of magnesium, a desirable increase in hardness is achieved.

Further, if the maximum amount of the first component that can homogeneously be mixed with magnesium into a solid solution is not exceeding 2 mass %, the effect of improvement in the proof stress was not able to be achieved.

This is because the maximum amount of the first component that can be homogeneously mixed with magnesium into a solid solution is so small that a proportion of the atoms of the first component for which the atoms of magnesium are substituted (the rate of formation of substitution solid solution) is low.

Figure 5:
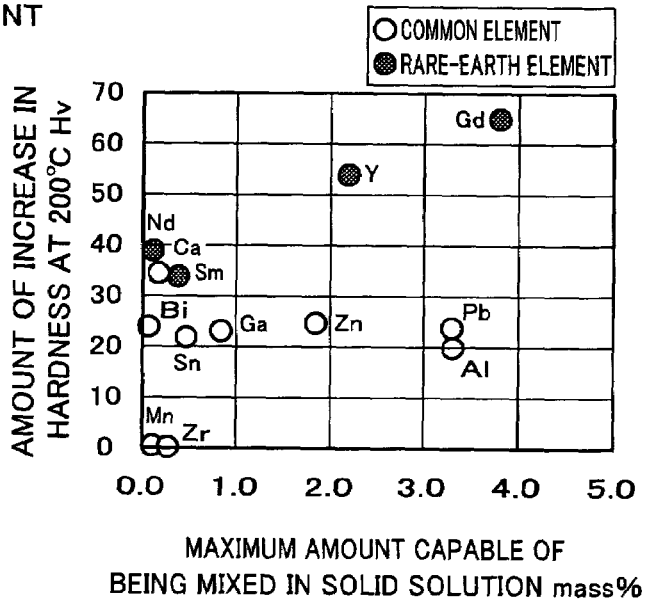
FIG. 5 is a diagram showing a relationship between maximum amounts of the first component mixed with magnesium to be a solid solution, and amounts of increase in hardness of magnesium alloys.

FIG. 5 shows a relation between experimentally obtained maximum amounts of the first component homogeneously mixed with magnesium into a solid solution and increase in hardness of the alloys.

As apparent from FIG. 5, gadolinium (Gd) of which the maximum amount capable of being homogeneously mixed with magnesium atoms into a solid solution is 3.82 mass % exhibited an increase of 65.5 in hardness; among others, yttrium (Y) of which the maximum amount capable of being a solid solution is 2.20 mass % exhibited an increase of 54.1; neodymium (Nd) of which the maximum amount capable of being a solid solution is 0.12 mass % exhibited an increase of 39.2; and samarium (Sm) of which the maximum amount capable of being a solid solution is 0.39 mass % exhibited an increase of 33.8.

On the other hand, among other elements out of the scope of the present invention, for example, lead (Pb) of which the maximum amount capable of being a solid solution is 3.31 mass %, aluminum (Al) of which the maximum amount capable of being a solid solution is 3.32 mass % exhibited increases of 23.9 and 19.5 respectively; the increase comparable to the rare-earth elements could not be achieved. Tin (Sn) and Gallium (Ga) of which the maximum amount capable of being a solid solution is not exceeding 2.0 mass % exhibited the same consequences.

As clearly shown from the above, if the maximum amount of the first component capable of homogeneously mixed with magnesium atoms into a solid solution is equal to or greater than 2 mass %, a favorable increase in hardness can be achieved.

For reasons as described above, preferable first components to be homogeneously mixed with magnesium into a solid solution may include holmium (Ho), dysprosium (Dy), terbium (Tb), gadolinium (Gd), yttrium (Y), and the like, of which the atomic radius is 9–14% larger than the radius of magnesium atoms, and the maximum amount capable of being a solid solution with magnesium is equal to or greater than 2 mass %.

Figure 6:
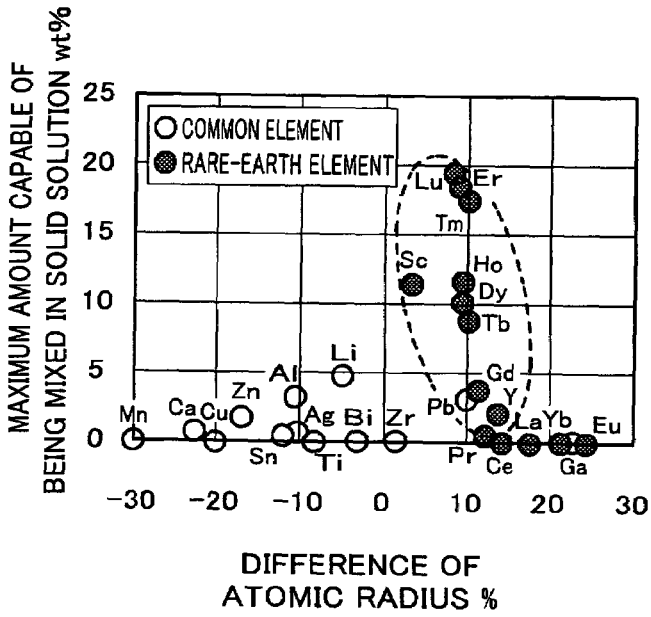
FIG. 6 is a diagram showing a relationship between percentages of differences between atomic radii of the first components homogeneously mixed with magnesium to be a solid solution and the atomic radius of magnesium, and maximum amounts of the first components capable of being homogeneously mixed with magnesium into a solid solution.

FIG. 6 is a diagram showing a relationship between percentages of differences between atomic radii of the first components homogeneously mixed with magnesium to be a solid solution and the atomic radius of magnesium, and maximum amounts of the first components capable of being homogeneously mixed with magnesium into a solid solution. Values shown in FIG. 6 are also those obtained by experiment.

As clearly shown in the above discussion, the use of the rare-earth elements of which the atomic radii are 9–14% larger than that of magnesium and the maximum amounts capable of being a solid solution with magnesium atoms are equal to or greater than 2 mass % would lead to favorable effects.

To be more specific, other than the aforementioned first components, for example, lutetium (Lu), erbium (Er), thulium (Tm) and such rare-earth elements may be added to produce alloys having superiority in hardness.

Conventionally designed preparation of magnesium alloys utilizes aluminum (Al) or zinc (Zn) for an additive element in many instances. However, the atomic radii thereof are smaller than that of magnesium, and thus the use thereof could not produce alloys exhibiting preferred hardness in high temperature surroundings.

Accordingly, mixing such elements as are out of the aforementioned range (i.e., the atomic radius thereof is 9–14% larger than the atomic radius of magnesium; the maximum amount capable of being a solid solution with magnesium is equal to or greater than 2 mass %) with magnesium is not preferable to form the present mode of magnesium alloys.

Hereupon, it is understood as described above that an upper limit of the amount of the first component to be added is the maximum amount of the element capable of being a solid solution with magnesium as the first component is to be homogeneously mixed with magnesium into a solid solution. A lower limit of the amount is not particularly restricted, as far as the amount is sufficient to achieve the objects of the present invention. Therefore, the amount of the first component to be added may be determined as appropriate with consideration given to costs and the like of magnesium alloys to be produced.

To illustrate more specifically, for example, assuming that gadolinium (Gd) is chosen as an element to be added, the amount thereof to be added is preferably 0.5–3.8 mass %, more preferably 1.0–3.5 mass %, or so, as will be described later.

<Second Component>

In the first mode of magnesium alloys according to the present invention, in addition to the above-described first component, an element of which a mixture with magnesium has an eutectic point of 540° C. or greater (hereinafter referred to as "second component") may further be added, as will be described later, for the purpose of impeding steady-state creep.

Usable elements for the second components are elements of which a mixture with magnesium has a eutectic point of 540° C. or greater and a melting point lower than magnesium. Preferably, for example, lanthanum (La), cerium (Ce), neodymium (Nd), or other rare-earth elements, or tin (Sn), barium (Ba), etc. may be added.

To be more specific, when the second component that meets the above conditions is added, the second component forms eutectic compounds with atoms of magnesium, and the eutectic compounds diffuse into interfaces or grain boundaries between individual grains making up magnesium. Since the eutectic compounds formed as above are stable at high temperatures, diffusion of atoms in grain boundaries can be effectively inhibited even under high temperature conditions, and thus the steady-state creep of magnesium alloys can be impeded.

Hereupon, if the eutectic point of the mixture of the second component with magnesium were lower than 540° C., the steady-state creep elongation would disadvantageously become greater. This is because diffusion of atoms becomes likely to occur in the eutectic compound under high temperature conditions and thus deformation in the grain boundaries cannot be impeded at high temperatures.

Figure 7:
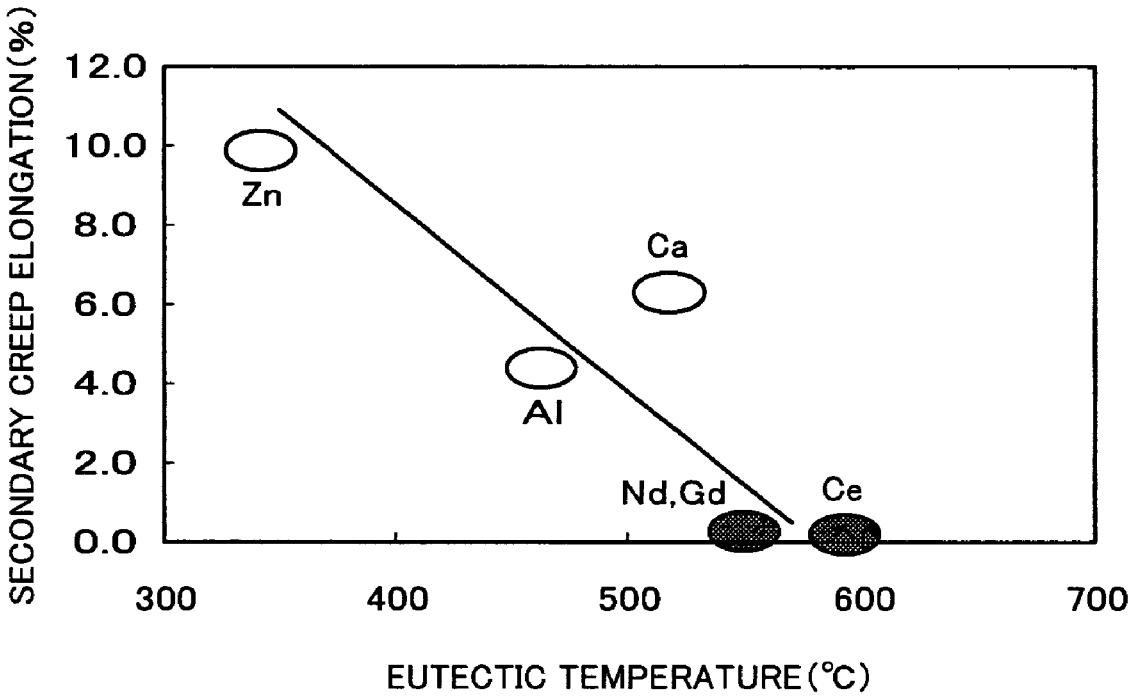
FIG. 7 is a diagram showing a relationship between experimentally determined eutectic points of a second component mixed with magnesium to be a solid solution, and steady-state creep elongations.

FIG. 7 shows a relationship between experimentally determined eutectic points of the second component mixed with magnesium to be a solid solution, and steady-state creep elongations thereof.

As apparently shown in FIG. 7, gadolinium (Gd), cerium (Ce) or the like of which a mixture with magnesium has an eutectic point of 540° C. or greater exhibits a minimized steady-state creep elongation (%).

Consequently, the second component used for the present invention is preferably an element of which a mixture with magnesium has a eutectic point of 540° C. or greater and which has a melting point lower than magnesium.

The effect of impeding steady-state creep deformation is subject to a temperature at which the compound is formed, i.e., the eutectic point; the effect is enhanced in accordance with the temperature. Accordingly, elements among lanthanoids as recited above may be arranged in descending order of effectiveness as follows: lanthanum (La), cerium (Ce), praseodymium (Pr), europium (Eu), neodymium (Nd), and samarium (Sm).

With respect to the amount of the second component to be added, if the rate of the second component added were less than one mass %, the amount of the eutectic compounds generated would be reduced, and thus diffusion of atoms occurring in the grain boundaries could not be inhibited, so that the objects and advantages expected from addition of the second component could not sufficiently be achieved. If the rate of the second component added were 15 mass % or greater, the amount of the eutectic compounds generated would become too much, and thus elongation capability of the magnesium alloys would disadvantageously be lowered to an appreciable extent.

The magnesium material applied to a structural material needs to have a sufficient strength at high temperatures, i.e., tensile strength, proof stress, and creep strength, but such an arrangement as prepared with consideration given only to the strength at high temperatures would involve a difficulty in practicability in some instances. It is a balance kept between strength and elongation that matters. It is understood as an adequate level of elongation that the structural material, in particular as used in an engine for a vehicle, needs to have an elongation percentage of approximately 2.0% or greater. Therefore, the sufficient strength at high temperatures and sufficient level of elongation should both be secured.

Consequently, the amount of the second component to be added according to the present invention falls within the range of: preferably 1–15 mass %, and more preferably 3–8 mass %.

<Third Component>

Moreover, the first mode of magnesium alloys according to the present invention may further contain in addition to the above first component and second component one or more elements selected from a group consisting of zirconium (Zr), strontium (Sr), and manganese (Mn) (hereinafter referred to as "third component") with a content thereof being less than 1 mass %.

Minor amounts of the elements as recited above are added to the magnesium alloys, to make grain sizes of magnesium crystals smaller.

The grain size of each crystal of magnesium alloys greatly depends upon solidification rates in general, and the smaller the grain sizes of the crystals, the greater the proof stress tends to be.

In a thick portion, the solidification progresses slowly; resultantly the grain sizes of the crystals tend to become larger and the strength thereof tends to become lower.

With the third component, even in thick portions in which the solidification progresses slowly, the grain sizes of the crystals can be made very small, as small sizes as can be attained in thinner portions in which the solidification progresses more rapidly. Moreover, the compounds in the grain boundaries diffuse evenly, and variation of strength under high temperature conditions in each portion can thereby fall within an adequately narrow range.

Figure 8:
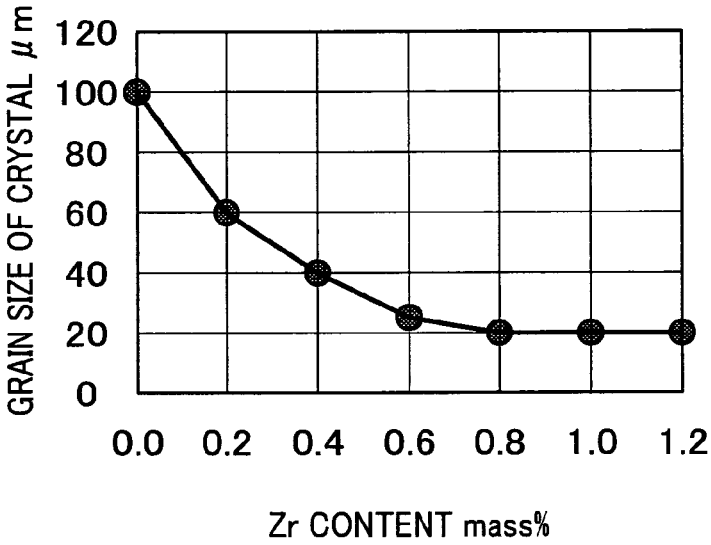
FIG. 8 is a diagram showing a relationship between a zirconium (Zr) content in an alloy to which zirconium (Zr) is added as a third component, and particle sizes of the alloy.

A relationship between a zirconium (Zr) content in an alloy, to which zirconium (Zr) is added as the third component, and grain sizes of the alloy is shown in FIG. 8. In other words, the graph shows variation of grain sizes in accordance with the amount of zirconium (Zr) added to the magnesium alloy according to the present invention, which amount ranges from 0.0 through 1.2 mass %.

As shown in FIG. 8, as the amount of zirconium (Zr) added increases, the grain size of crystals decreases. When zirconium (Zr) exceeding 0.8 mass % is added, the effect of addition of zirconium (Zr) shows up at a maximum thereof. Since zirconium (Zr) reacts with magnesium to form peritectoid, and upon solidification, zirconium (Zr) becomes a solidification nucleus of a magnesium crystal, the grain becomes small.

When the amount of the third component added becomes 1 mass % or greater, a great number of relatively brittle compounds are generated in the grains or grain boundaries. The relatively brittle compounds could cause brittle fracture; therefore, a great number of the relatively brittle compounds generated in the grains or grain boundaries would markedly lower the elongation capability of the magnesium alloys, and lower the strength of the magnesium alloys.

It is understood that the effect of addition of the third component can be achieved when strontium (Sr) or manganese (Mn) is used, as well.

Accordingly, the amount of addition of the third component in the first mode of magnesium alloys according to the present invention preferably falls below 1 mass %, and more preferably ranges between 0.5 and 0.8 mass %.

The third component does not necessarily have to be used in combination with the first component and the second component, but may be used only with the first component.

In this instance, the magnesium alloys composed of magnesium, the first component and the third component can serve to effectively achieve improvement of the proof stress and impede the primary creep deformation under high temperature environments through formation of the substitution solid solution and small-sized grains.

As discussed above, the first mode of magnesium alloys according to the present invention exhibits high proof stress and high creep strength under high temperature conditions, and can thus be employed for structural materials to be used under high temperature conditions, such as structural materials for a vehicle, in particular, those which lend itself to a cylinder block, a cylinder head, an intake manifold, a head cover, a chain case, an oil pan, a transmission case, an ECU frame, and other structural members to be mounted around the engine of the vehicle.

[Second Mode]

A description will be given below of requirements for a second mode of magnesium alloys according to the present invention. The second mode of magnesium alloys is characterized by having a gadolinium (Gd) content of 0.5–3.8 mass % in above-described magnesium as a principal ingredient, i.e., the remaining part is composed of magnesium and unavoidable impurities.

<First component: Gd>

The second mode of magnesium alloys has a gadolinium, as a first component, in an amount of 0.5–3.8 mass %, homogeneously mixed in a solid solution with magnesium for the purposes of preventing the decrease of proof stress under high temperature conditions and the deformation derived from the primary creep (RANGE a in FIG. 3).

In the second mode of magnesium alloys of this composition, atoms of the first component homogeneously mixed into a solid solution are substituted for some of magnesium atoms in the grains to form a substitution solid solution, and microscopic lattice distortion is thus generated in the crystals. Then the microscopic lattice distortion serves to inhibit deformation in grains of magnesium which would appear when the magnesium is exposed in high temperature surroundings. As a result, the proof stress and tensile strength which are subject to the internal strength of the grains can be improved, and the primary creep deformation can be impeded.

The reason why gadolinium is selected as the first component of the second mode of magnesium alloys is that the atomic radius of gadolinium is larger than that of magnesium, and that the maximum amount of gadolinium allowed to be a solid solution when mixed with magnesium is larger, and thus the effect of inhibiting deformation is higher, than any other elements.

Since gadolinium is to be a solid solution when mixed with magnesium, even if more than the maximum amount of gadolinium allowed to form a solid solution in magnesium is added, an excess amount of gadolinium is not homogeneously mixed with magnesium into a solid solution. Therefore, in the present invention, the upper limit of a gadolinium content is 3.8 mass % that is the maximum amount of gadolinium allowed to form a solid solution.

The lower limit of a gadolinium content to be mixed into a solid solution is not restricted to a specific value, as far as the object of the present invention can be achieved. The amount may be determined as appropriate with consideration given to manufacturing costs of magnesium alloys, or the like.

Consequently, the gadolinium content in the second mode of magnesium alloys according to the present invention is preferably 0.5–3.8 mass %, and more preferably 1.0–3.5 mass %, or so.

<Second Component>

The second mode of magnesium alloys according to the present invention may further include in addition to gadolinium as the above first component, one or more elements selected from a group consisting of lanthanum through europium among lanthanoids in the periodic table of the elements (hereinafter referred to as "second component") with a content thereof ranging from 1 to 15 mass % for the purpose of impeding steady-state creep deformation.

The second components that may preferably be added include lanthanum (La), cerium (Ce), praseodymium (Pr), neodymium (Nd), promethium (Pm), samarium (Sm), and so forth.

To be more specific, when the second component that meets the above conditions is added, the second component is combined with atoms of magnesium to form eutectic compounds, and the eutectic compounds diffuse into grain boundaries. Since thus-formed eutectic compounds are stable at high temperatures, diffusion of atoms in grain boundaries can be effectively inhibited even under high temperature conditions, and thus the steady-state creep of magnesium alloys can be impeded.

The effect of impeding the steady-state creep deformation increases with the temperature at which the compounds are formed, i.e., the eutectic point; the effect is enhanced in accordance with the temperature. Among the aforementioned lanthanoids, the effect is likely to become higher in the following order: lanthanum, cerium, praseodymium, europium, neodymium, and samarium.

In particular, since the maximum amount of the elements belonging to the group consisting of lanthanoids as exemplified above that may be homogeneously mixed with magnesium atoms into a solid solution is small, even if a small amount of the elements are added, eutectic compounds are formed in the grain boundaries.

The effect of impeding steady-state creep deformation is subject to a temperature at which the compound is formed, i.e., the eutectic point; the higher the eutectic point, the higher the effect becomes; accordingly, elements among lanthanoids as recited above may be arranged in descending order of effectiveness as follows: lanthanum, cerium, praseodymium, europium, neodymium, and samarium.

Hereupon, if the rate of the second component added were less than one mass %, the amount of the eutectic compounds formed would be reduced, and thus diffusion of atoms occurring in the grain boundaries could not be inhibited, so that the objects and advantages expected from addition of the second component could not sufficiently be achieved.

Moreover, if the rate of the second component added were 15 mass % or greater, the amount of the eutectic compounds formed would become too much, and thus elongation capability of the magnesium alloys would disadvantageously be lowered to an appreciable extent.

The magnesium material applied to a structural material needs to have a sufficient strength at high temperatures, i.e., tensile strength, proof stress, and creep strength, but such an arrangement as prepared with consideration given only to the strength at high temperatures would involve a difficulty in practicability in some instances. It is a balance kept between strength and elongation that matters. It is understood as an adequate level of elongation that the structural material, in particular as used in an engine for a vehicle, needs to have an elongation percentage of approximately 2.0% or greater. Therefore, the sufficient strength at high temperatures and sufficient level of elongation should both be secured.

Accordingly, the amount of the second component to be added according to the present invention falls within the range of: preferably 1–15 mass %, and more preferably 3–8 mass %.

Consequently, the second mode of magnesium alloys which is composed of magnesium, the first component and the second component brings about inhibition of steady-state creep deformation due to eutectic compounds, as well as improvement of proof stress and inhibition of primary creep deformation due to formation of the above-described substitution solid solution, and can thus achieve effective improvement of the proof stress and creep strength of magnesium alloys under high temperature environments.

<Third Component>

Moreover, the second mode of magnesium alloys as described above may further contain in addition to the above first component and second component as in the first mode one or more elements selected from a group consisting of zirconium, strontium, and manganese (hereinafter referred to as "third component") with a content thereof being less than 1 mass %, as in the first mode.

The functions performed by these elements are the same as discussed in the first mode, and thus a description thereof will be omitted herein.

With the third component, even in portions where the solidification progresses slowly, the grain sizes of the crystals can be made very small, as small sizes as can be attained in thinner portions where the solidification progresses faster. Moreover, the compounds in the grain boundaries diffuse evenly, and variation of strength under high temperature conditions in each portion can thereby fall within an adequately narrow range.

A relationship between a Zr content in an alloy, to which Zr is added as the third component, and grain sizes of the alloy is shown in FIG. 8. In other words, FIG. 8 shows variation of grain sizes in accordance with the amount of Zr added to the magnesium alloy according to the present invention, which amount ranges from 0.0 through 1.2 mass %. As shown in FIG. 8, as the amount of Zr added increases, the grain size of crystals decreases. When Zr of which the content exceeds 0.8 mass % is added, the effect of addition of Zr shows up at a maximum thereof.

Hereupon, when the amount of the third component added becomes 1 mass % or greater, a great number of relatively brittle compounds are generated in the grains or grain boundaries. Therefore, the relatively brittle compounds could cause the elongation capability of the magnesium alloys to decrease drastically, and the strength of the magnesium alloys to decline.

Accordingly, the amount of addition of the third component in the second mode of magnesium alloys according to the present invention preferably falls below 1 mass %, and more preferably ranges between 0.5 and 0.8 mass %.

The third component does not necessarily have to be used in combination with the first component and the second component, but may be used only with the first component.

In this instance, the magnesium alloys composed of magnesium, the first component and the third component can serve to effectively achieve improvement of the proof stress and impede the primary creep deformation under high temperature environments through formation of the substitution solid solution and small-sized grains.

As discussed above, the second mode of magnesium alloys according to the present invention exhibits high proof stress and high creep strength under high temperature conditions, and can thus be employed for structural materials to be used under high temperature conditions, such as structural materials for a vehicle, in particular, those which lend itself to a cylinder block, a cylinder head, an intake manifold, a head cover, a chain case, an oil pan, a transmission case, an ECU frame, and other structural members to be mounted around the engine of the vehicle.

[Third Mode]

A description will be given below of requirements for a third mode of magnesium alloys according to the present invention. The third mode of magnesium alloys is characterized by having a cerium content of 2.0–10.0 mass %, a tin content of 1.4–7.0 mass % in magnesium as a principal ingredient, i.e., the remaining part is composed of magnesium and unavoidable impurities.

<First Component: Ce+Sn>

The third mode of magnesium alloys contains cerium (Ce) in an amount of 2.0–10.0 mass %, preferably 4.0–6.0 mass %, and tin (Sn) in an amount of 1.4–7.0 mass %, preferably 3.5–6.5 mass % (hereinafter referred to as "first component") in addition to magnesium as a principal ingredient for the purpose of impeding steady-state creep. Thus, the third mode of magnesium alloys is designed to impede steady-state creep in magnesium alloys to be prepared, utilizing a synergistic effect of addition of the both elements, cerium (Ce) and tin (Sn) each added in specific amounts.

Hereupon, when cerium and tin are added to magnesium, an acicular eutectic compound with the ternary system of magnesium, cerium and tin is formed. Thus-formed eutectic compounds then diffuse into interfaces or grain boundaries between individual grains making up magnesium. As a result, the eutectic compounds which are stable at high temperatures serve to inhibit diffusion that could be caused under high temperature environments, and the inhibitive capability inherent in acicular compounds serves to inhibit a slip of one grain over another, thereby inhibiting creep deformation of the magnesium alloys.

If the amount of cerium (Ce) added were below 2.0 mass %, or if the amount of tin (Sn) added were below 1.4 mass %, the amount of eutectic compounds that could be formed would be insufficient, and thus the steady-state creep deformation could not be inhibited sufficiently.

Conversely, if the amount of cerium (Ce) added were more than 10.0 mass %, or if the amount of tin (Sn) added were more than 7.0 mass %, the amount of eutectic compounds that could be formed would become too much, and thus the elongation capability of the magnesium alloys would be lowered to an appreciable extent.

Accordingly, the amounts of cerium (Ce) and/or tin (Sn) to be added to magnesium alloys falling out of the above ranges respectively would disadvantageously prevent the resulting magnesium alloys from achieving sufficiently high creep strength.

The ratio between the amounts of cerium (Ce) and tin (Sn) to be added ranges preferably 0.6–1.4, and more preferably 1.0–1.2, (cerium-to-tin ratio, Ce/Sn) in mass.

If the ratio (cerium to tin, Ce/Sn) in mass were less than 0.6, the percentage of Mg—Sn compounds and/or single-phase tin (Sn) that could be formed in the grain boundaries in addition to the eutectic compounds having the ternary system of magnesium, cerium and tin would increase.

Of the two, particularly, the single-phase tin (Sn) has a low melting point, and thus the creep strength of magnesium alloys tends to decrease with increase in percentage of the single-phase tin (Sn) contained in the grain boundaries.

If the ratio (cerium to tin, Ce/Sn) in mass were more than 1.4, the percentage of Mg—Ce compounds that could be formed in the grain boundaries in addition to the eutectic compounds having the ternary system of magnesium, cerium and tin would increase.

The Mg—Ce compounds are lower in stability than Mg—Ce—Sn ternary compounds at 150° C. or higher, and thus the creep strength of magnesium alloys tends to decrease with increase in percentage of the Mg—Ce compounds contained in the grain boundaries.

Therefore, the ratio between the amounts of cerium (Ce) and tin (Sn) to be added preferably falls within the above range.

<Second Component>

Moreover, the third mode of magnesium alloys according to the present invention may further contain in addition to the above-described first component one or more elements selected from a group consisting of zirconium (Zr), strontium (Sr), and manganese (Mn) (hereinafter referred to as "second component") with a content thereof being less than 1 mass %.

Minor amounts of the elements as recited above are added to the magnesium alloys, to make grain sizes of magnesium crystals smaller.

As discussed above, the grain size of each crystal of magnesium alloys greatly depends upon solidification rates in general, and the smaller the grain sizes of the crystals, the greater the proof stress tends to be.

In a thick portion of magnesium alloys, the solidification progresses slowly; resultantly the grain sizes of the crystals tend to become larger and the strength thereof tends to become lower.

With the second component, even in thick portions in which the solidification progresses at a relatively low speed, the grain sizes of the crystals can be made very small, as small sizes as can be attained in thinner portions in which the solidification progresses more rapidly. Moreover, the compounds in the grain boundaries diffuse evenly, and variation of strength under high temperature conditions in each portion can thereby fall within an adequately narrow range.

A relationship between a zirconium (Zr) content in an alloy, to which zirconium (Zr) is added as the second component, and grain sizes of the alloy is shown in FIG. 8. In other words, FIG. 8 shows variation of grain sizes in accordance with the amount of zirconium (Zr) added to the third mode of magnesium alloys according to the present invention, which amount ranges from 0.0 through 1.2 mass %. As shown in FIG. 8, as the amount of zirconium (Zr) added increases, the grain size of crystals decreases. It is shown that when zirconium (Zr) exceeding 0.8 mass % is added, the effect of addition of zirconium (Zr) shows up at a maximum thereof.

When the amount of the second component added becomes 1 mass % or greater, a great number of relatively brittle compounds are generated in the grains or grain boundaries. Therefore, the relatively brittle compounds would markedly lower the elongation capability of the magnesium alloys, and lower the strength of the magnesium alloys. It is understood that the effect of addition of the second component can be achieved when strontium (Sr) or manganese (Mn) is used, as well.

Accordingly, the amount of addition of the second component according to the present invention preferably falls below 1 mass %, and more preferably ranges between 0.5 and 0.8 mass %.

Consequently, the magnesium alloys composed of the first component and the second component in addition to magnesium can bring about inhibition of primary creep deformation due to formation of small-sized grains as well as inhibition of steady-state creep due to formation of eutectic compounds, and can thus achieve effective improvement of the tensile strength and proof stress of magnesium alloys under high temperature environments.

As described above, the third mode of magnesium alloys according to the present invention exhibits high creep strength under high temperature conditions, and can thus be employed for structural materials to be used under high temperature conditions, such as structural materials for a vehicle, in particular, those which lend itself to a cylinder block, a cylinder head, an intake manifold, a head cover, a chain case, an oil pan, a transmission case, an ECU frame, and other structural members to be mounted around the engine of the vehicle.

The first through third modes of magnesium alloys according to the present invention as described above may be manufactured for example by a casting process as will be described hereafter. That is, the magnesium or magnesium alloys to which a specific amount of yttrium (Y) is added are molten; at a top surface of resulting molten metal of the magnesium or magnesium alloys obtained through the melting step is then formed a film of oxide made of yttrium (Y), which makes it possible to cast the magnesium alloys according to the present invention, while preventing oxidization and combustion of the magnesium or magnesium alloy.

Hereupon, the magnesium is composed of magnesium, as a principal ingredient, and unavoidable impurities; the magnesium alloy is composed of magnesium, as a principal ingredient, additive elements, and unavoidable impurities. The additive elements are metal elements to be added to magnesium as appropriate in accordance with intended properties of the magnesium alloys. The additive elements that are well known include aluminum, for example.

The above-described casting process of magnesium alloys according to the present invention is designed for such magnesium and magnesium alloys.

Hereinafter, such magnesium and magnesium alloys will be generically called "magnesium materials" as necessary.

<Molten Magnesium Materials>

In general, when a part is formed of a magnesium material, first the magnesium material is molten into a molten material. The molten magnesium material is then cast into a mold, and cooled and solidified in the mold, so that the part is formed of the magnesium material.

In general, features of the molten magnesium material include: upon contact with oxygen in the atmosphere, burning with a dazzling light occurs, forming a white powder of magnesium oxide (MgO); and upon contact with heated iron oxide, vigorous reaction occurs, reducing iron oxide with the liberation of iron as a simple substance, to form magnesium oxide (MgO). Accordingly, care should be exercised in handling the molten magnesium material so as to avoid unintended oxidation and burning, and particularly to avoid contact with oxygen.

(Yttrium (Y))

In the casting process of magnesium or magnesium alloys according to the present invention, in order to prevent oxidation and burning of the molten magnesium material that could be caused by oxygen in the atmosphere during the casting process, yttrium (Y) of which a content is 0.002 mass % or greater, preferably 0.002–1.0 mass %, more preferably 0.002–0.3 mass % is added to the magnesium material.

Thereafter, when the magnesium material to which yttrium (Y) is added gets molten, at a top surface of the molten magnesium material is formed a dense film of oxide including yttrium (Y). The film of oxide serves to keep the molten magnesium material from contact with oxygen in the atmosphere, and thus prevents oxidation and burning of the molten magnesium material.

It is understood that the minimum amount of addition of yttrium (Y) is the value obtained by experiment. A description will be given below of the reason the amount of addition of yttrium (Y) was determined within the above ranges, with reference to FIG. 9.

Figure 9:
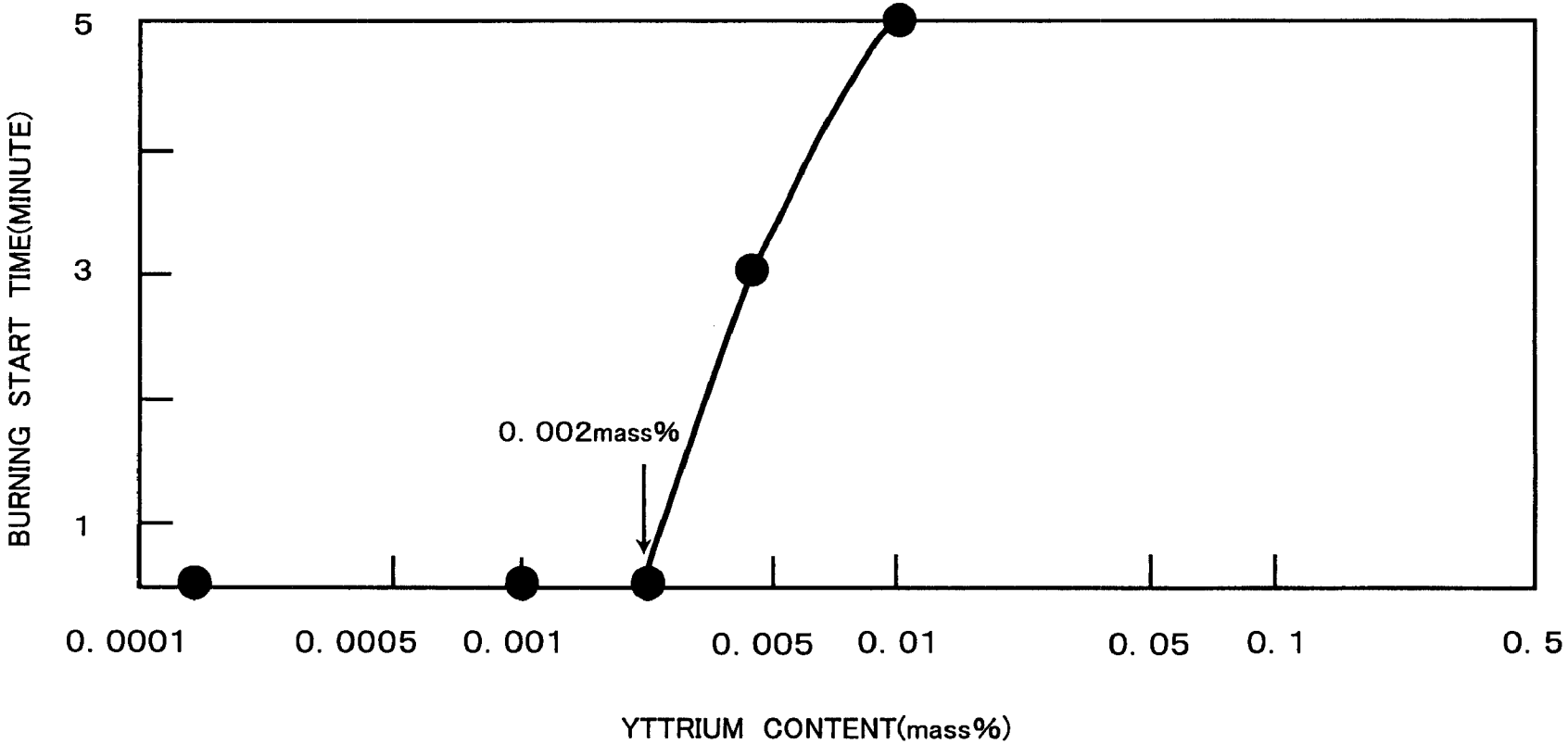
FIG. 9 is a graph showing a relationship between the time required till molten metal of magnesium with an yttrium (Y) content starts burning, and amounts of yttrium (Y) added.

FIG. 9 is a graph showing a relationship between the time required till molten metal of magnesium with an yttrium (Y) content starts burning, and amounts of yttrium (Y) added, where the molten metal of magnesium to which yttrium (Y) is added is exposed in an oxygen-containing environment.

In FIG. 9, when the amount of yttrium (Y) added was less than 0.002 mass %, exposure of the molten metal of magnesium, to which yttrium (Y) was added, to an oxygen-containing environment caused the molten metal of magnesium with an yttrium content to start burning within a very short time. This is because a dense film of oxide including yttrium (Y) was less formed on a top surface of the molten metal of magnesium.

It has been shown that if the amount of yttrium (Y) added is more than 0.002 mass %, the effect of inhibition of burning appears and gradually increases with the amount.

When the amount of yttrium (Y) added were 0.005 mass %, the molten metal of magnesium with the yttrium (Y) content did not burn until approximately three minutes had passed after the alloy was put into an oxygen-containing environment.

Subsequently, likewise, the time for which the burning were being inhibited became longer with the increase of the amount of yttrium (Y) added; when the amount of yttrium (Y) added was more than 0.01 mass %, even when the molten metal of magnesium was exposed in an oxygen-containing environment for five minutes, the burning of the molten metal of magnesium did not occur.

As described above, the experimental results shown in FIG. 9 revealed that the lower limit of the amount of yttrium (Y) to be added to magnesium is 0.002 mass %.

Consequently, in the casting process by which the magnesium alloy according to the present invention may be manufactured, if yttrium (Y) added to a magnesium material is 0.002 mass % or greater, the objects of the present invention can be achieved.

Hereupon, since yttrium (Y) is a relatively expensive element, an increased amount of yttrium (Y) added would disadvantageously impair cost efficiency. Moreover, an excessive amount of yttrium (Y) added could possibly make the yttrium (Y) alloyed with magnesium. For these and other reasons, the amount of addition of yttrium (Y) in the casting process of magnesium materials may preferably be that which may serve to form a film of oxide on a top surface of the molten metal of magnesium materials in the minimum amount required to inhibit oxidation and burning of the molten metal of magnesium.

Accordingly, the upper limit of the amount of yttrium (Y) to be added to magnesium materials may be appropriately determined in accordance with the cost of magnesium alloys to be manufactured or workability of pouring molten metal of magnesium into a mold, and 0.3 mass % (producing a film of oxide of approximately 0.05 mm in thickness) is an amount in which the intended effect can be achieved sufficiently without impairing the workability.

According to the casting process of magnesium or magnesium alloys as described above, a film of oxide containing yttrium (Y) is formed on a top surface of the molten metal of the magnesium or magnesium alloys, and thus the molten metal of the magnesium or magnesium alloys is shut out from oxygen contained in the air. Therefore, the oxidation and burning of the molten metal of the magnesium or magnesium alloys can be prevented.

The effect of addition of yttrium (Y) can be achieved appropriately even when the temperature of the molten metal of magnesium materials is high; e.g., 700° C. or higher, and even if the molten metal of magnesium materials to which yttrium (Y) is added is kept under high temperature conditions for a long time, as were the case with beryllium or calcium used in conventional burning prevention methods, the amount of the element which exists in the molten metal of magnesium materials is not reduced over time.

Moreover, when magnesium materials are cast from molten metal of magnesium materials to which yttrium (Y) is added, the grain size of each crystal structure (particle) of yttrium (Y) does not become coarse. In other words, the grain size of each crystal structure (particle) of the magnesium materials resulting from the casting process is restricted to be small, and thus, the magnesium materials having high heat resistance can be obtained.

Further, the use of the molten metal of magnesium materials to which yttrium (Y) is added makes the molten metal of magnesium materials easy-separable. Thus, when the molten metal of magnesium materials is poured into the mold, the molten metal of magnesium materials is prevented from clinging to a ladle, unlike molten metal of magnesium alloys to which no yttrium (Y) is added.

Furthermore, separation of the mold, when a casting is separated from the mold after the casting is formed, is easier; good workability can thus be achieved.

These are derived from the peculiar properties of a film of oxide containing yttrium (Y), such as a proper wetting characteristics, surface tension, and so forth.

The present inventors and their colleagues employed the casting process of magnesium alloys according to the present invention as described above, and carried out the casting of magnesium alloys in practice as will be described below.

In a protective gas (argon (Ar)+5% sulfur hexafluoride ($SF_6$)) atmosphere, pure magnesium to which yttrium (Y) in an amount of 0.028 mass % was added, and pure magnesium as a comparative example to which no yttrium (Y) was added, were respectively heated in a small-sized smelting furnace (10 kg) until each melted at 700° C.

The melting of magnesium was performed in a melting pot made of boiler steel of which the inside had been calorized. The dimensions of the pot were 150 mm in inside diameter, 200 mm in depth, and 177 $cm^2$ in surface area of the molten metal in contact with outside air. The thickness of the film of oxide formed on the surface of the molten metal of magnesium materials was approximately 0.05 mm.

After the molten metal was kept at 700° C. for five minutes, the protective gas was stopped, the lid of the pot was removed, and the change of the surface of the molten metal was observed.

Even if five minutes have passed since the protective gas was stopped, the molten metal of the pure magnesium to which yttrium (Y) had been added did not burn.

On the other hand, the molten metal of pure magnesium to which no yttrium (Y) was added started burning approximately 10 minutes after the protective gas was stopped, and black granular oxides generated by burning were recognized on the surface of the molten metal of the pure magnesium.

In order to cast the pure magnesium to which yttrium (Y) was added into a boat-shaped mold, molten metal of magnesium was poured into the mold. During the pouring operation, the molten metal of magnesium did not cling to the pot or the ladle, and thus the pouring operation was performed efficiently.

As discussed above, the present invention serves to prevent molten metal of magnesium or magnesium alloys from burning by adding a predetermined amount of yttrium (Y) to the magnesium or magnesium alloys.

Here, with the melting pot (150 mm in inside diameter, 200 mm in depth, and 177 $cm^2$ in surface area of the molten metal in contact with the outside air) used in the aforementioned example, the thickness of the film of oxide formed on the surface of the molten metal of magnesium was 0.05 mm when yttrium is added in the amount of 0.3 mass %, and 0.2 mm when yttrium is added in the amount of 1.0 mass %.

More specifically, the larger the amount of yttrium (Y) added, the more stable film of oxide is formed on the surface of molten metal of magnesium. However, it has been shown that if the film of oxide becomes too thick, the workability in pouring molten metal of magnesium into the mold tends to decrease, and that in view of workability, the thickness of the film of oxide should preferably be less than 0.05 mm.

Accordingly, in order to prevent molten metal of magnesium from burning as a result of contact with the outside air, the thickness of a film of oxide to be formed on the surface of molten metal of magnesium is less than 0.2 mm, and preferably less than 0.05 mm. The lower limit of the thickness of the film of oxide is the thickness of the film of oxide formed on the surface of molten metal of magnesium to which yttrium is added in the amount of 0.002 mass %, that is, approximately 0.01 mm.

Alternatively, since the thickness of the film of oxide gradually decreases when molten metal of magnesium is being poured into the mold, yttrium (Y) may be added as appropriate in accordance with the thickness of the film of oxide formed on the surface of molten metal of magnesium, or in accordance with the depth/residual amount of the molten metal in the melting pot.

The above-described casting process of magnesium alloys is applied not only to magnesium alloys according to the present invention, but also to magnesium or magnesium alloys in common use.

WORKING EXAMPLES

A detailed description will hereinafter be given of working examples of the present invention. It is however understood that the present invention is not limited to these examples.

First Working Examples

First, to prepare a material having the composition as shown in Table 1, pure magnesium was melted in an atmosphere of a mixture of gases consisting of argon and sulfur hexafluoride in an electric smelting furnace, and a first component and a second component each in a predetermined amount were charged, stirred, and rested. The resulting molten metal was poured into a metal mold 30 mm high, 25 mm wide, and 200 mm long, to obtain a casting material.

The melting process was carried out in a melting pot of which the inside had been calorized, and the charging of the elements was performed when the temperature of the pure magnesium was 700° C.

The casting material was soaked for 100-hr. thermal hysteresis in an atmosphere at 200° C., and thereafter, a tensile test specimen and a creep test specimen were taken out and subjected to the tensile test and the creep test. JIS No. 4 Piece was used for the test specimens.

The tensile test was conducted using a 5-ton Autograph Tester in an atmosphere at 200° C. at a tensile speed of 0.5 mm/minute. In the creep test, a load of 50 MPa is given at 200° C. for 100 hrs to measure an entire elongation percentage.

TABLE 1

| | First element (wt %) | Atomic radius differential between first element and magneium (%) | Second element (wt %) | Eutectic temperature of second element (° C.) | Characteristics in strength at 200° C. 0.2% proof stress (MPa) | Elongation (%) | Entire creep elongation 50 MPa, 100 Hr (%) |
|---|---|---|---|---|---|---|---|
| Comparative Example 1 | 0.5 Ca | 23.1 | 0.8 Si | 638 | 20 | 23.0 | Ruptured halfway |
| Comparative Example 2 | 2.0 Ca | 23.1 | 1.0 Si | 638 | 45 | 16.5 | 6.950 |
| Comparative Example 3 | 2.0 Al | −10.6 | 0.8 Si | 638 | 70 | 85 | Ruptured halfway |
| Comparative Example 4 | 4.0 Al | −10.6 | 2.0 Nd | 548 | 100 | 10.0 | 2.250 |
| Comparative Example 5 | 5.0 Al | −10.6 | 3.0 Mm | 517 | 75 | 6.5 | 0.520 |
| Comparative Example 6 | 1.0 Zn | −16.9 | 3.0 Ca | 548 | 90 | 4.0 | 0.305 |
| Comparative Example 7 | 3.5 Gd | 11.3 | — | | 87 | 22.0 | 1.086 |
| Comparative Example 8 | 3.5 Gd | 11.3 | 20.0 Ce | 634 | 255 | 0.2 | 0.090 |

In like manner, the results from a test in which gadolinium (Gd) was employed as the first component are shown below in Table 2; the results from a test in which terbium (Tb) was employed as the first component are shown below in Table 3; the results from a test in which dysprosium (Dy) was employed as the first component are shown below in Table 4; the results from a test in which holmium (Ho) was employed as the first component are shown below in Table 5; and the results from a test in which yttrium (Y) was employed as the first component are shown below in Table 6.

TABLE 2

| | First element (wt %) | Atomic radius differential between first element and magneium (%) | Second element (wt %) | Eutectic temperature of second element (° C.) | Third element (wt %) | Characteristics in strength at 200° C. 0.2% proof stress (MPa) | Elongation (%) | Entire creep elongation 50 MPa, 100 Hr (%) |
|---|---|---|---|---|---|---|---|---|
| Example 1 | 0.8 Gd | 11.3 | 9.5 Nd | 548 | — | 120 | 7.5 | 0.150 |
| Example 2 | 3.5 Gd | 11.3 | 8.0 Nd | 548 | — | 185 | 8.0 | 0.065 |
| Example 3 | 4.1 Gd | 11.3 | 9.7 Nd | 548 | — | 178 | 3.0 | 0.102 |
| Example 4 | 3.4 Gd | 11.3 | 2.4 Nd | 548 | — | 84 | 11.5 | 0.240 |
| Example 5 | 3.6 Gd | 11.3 | 13.5 Nd | 548 | — | 275 | 4.2 | 0.078 |
| Example 6 | 3.5 Gd | 11.3 | 8.0 Ce | 634 | — | 175 | 6.0 | 0.085 |
| Example 7 | 3.5 Gd | 11.3 | 15.0 Ce | 634 | — | 265 | 3.0 | 0.095 |
| Example 8 | 1.0 Gd | 11.3 | 8.0 Ce | 634 | — | 120 | 7.5 | 0.150 |
| Example 9 | 3.5 Gd | 11.3 | 8.0 La | 613 | — | 130 | 8.0 | 0.160 |
| Example 10 | 3.7 Gd | 11.3 | 7.9 Pr | 575 | — | 163 | 6.5 | 0.295 |
| Example 11 | 3.5 Gd | 11.3 | 6.5 Sm | 540 | — | 140 | 5.4 | 0.362 |
| Example 12 | 3.5 Gd | 11.3 | 8.0 MM | (540) | — | 180 | 6.5 | 0.075 |
| Example 13 | 3.5 Gd | 11.3 | 8.0 Sn | 562 | — | 130 | 8.5 | 0.155 |
| Example 14 | 3.5 Gd | 11.3 | 8.0 Ba | 634 | — | 130 | 2.5 | 0.115 |
| Example 15 | 3.7 Gd | 11.3 | 8.5 Nd | 548 | 0.4 Zr | 180 | 7.4 | 0.070 |
| Example 16 | 3.6 Gd | 11.3 | 8.9 Nd | 548 | 0.8 Zr | 187 | 7.6 | 0.096 |
| Example 17 | 3.7 Gd | 11.3 | 7.6 Nd | 548 | 1.2 Zr | 198 | 8.5 | 0.150 |
| Example 18 | 3.5 Gd | 11.3 | 8.4 Nd | 548 | 0.5 Sr | 185 | 7.4 | 0.130 |
| Example 19 | 3.5 Gd | 11.3 | 8.7 Nd | 548 | 0.7 Mn | 188 | 8.3 | 0.087 |

MM is a rare-earth admixture (eutectic temperature thereof was evaluated with the lowest Sm)

TABLE 3

| | First element (wt %) | Atomic radius differential between first element and magneium (%) | Second element (wt %) | Eutectic temperature of second element (° C.) | Third element (wt %) | Characteristics in strength at 200° C. 0.2% proof stress (MPa) | Elongation (%) | Entire creep elongation 50 MPa, 100 Hr (%) |
|---|---|---|---|---|---|---|---|---|
| Example 20 | 1.2 Tb | 10.0 | 9.0 Nd | 548 | — | 168 | 8.9 | 0.130 |
| Example 21 | 8.4 Tb | 10.0 | 8.5 Nd | 548 | — | 250 | 5.5 | 0.075 |
| Example 22 | 11.4 Tb | 10.0 | 9.0 Nd | 548 | — | 289 | 3.9 | 0.065 |
| Example 23 | 8.6 Tb | 10.0 | 14.0 Nd | 548 | — | 315 | 2.5 | 0.110 |
| Example 24 | 8.2 Tb | 10.0 | 6.4 Ce | 634 | — | 250 | 6.5 | 0.100 |
| Example 25 | 5.0 Tb | 10.0 | 8.0 MM | (540) | — | 205 | 5.0 | 0.150 |
| Example 26 | 7.9 Tb | 10.0 | 7.0 Sn | 562 | — | 180 | 4.5 | 0.156 |
| Example 27 | 8.1 Tb | 10.0 | 8.9 Nd | 548 | 0.7 Zr | 250 | 5.8 | 0.120 |
| Example 28 | 7.3 Tb | 10.0 | 8.4 Nd | 548 | 0.3 Sr | 260 | 6.6 | 0.120 |
| Example 29 | 8.2 Tb | 10.0 | 8.7 Nd | 548 | 0.6 Mn | 260 | 4.5 | 0.115 |

MM is a rare-earth admixture (eutectic temperature thereof was evaluated with the lowest Sm)

TABLE 4

| | First element (wt %) | Atomic radius differential between first element and magneium (%) | Second element (wt %) | Eutectic temperature of second element (° C.) | Third element (wt %) | Characteristics in strength at 200° C. 0.2% proof stress (MPa) | Elongation (%) | Entire creep elongation 50 MPa, 100 Hr (%) |
|---|---|---|---|---|---|---|---|---|
| Example 30 | 0.6 Dy | 9.4 | 9.5 Nd | 548 | — | 144 | 9.5 | 0.150 |
| Example 31 | 5.0 Dy | 9.4 | 8.0 Nd | 548 | — | 215 | 7.0 | 0.065 |
| Example 32 | 11.4 Dy | 9.4 | 9.7 Nd | 548 | — | 305 | 6.0 | 0.085 |
| Example 33 | 9.8 Dy | 9.4 | 2.4 Nd | 548 | — | 220 | 6.8 | 0.159 |
| Example 34 | 9.5 Dy | 9.4 | 14.1 Nd | 548 | — | 285 | 3.5 | 0.065 |
| Example 35 | 8.9 Dy | 9.4 | 5.9 Ce | 634 | — | 235 | 4.0 | 0.125 |
| Example 36 | 9.7 Dy | 9.4 | 8.0 MM | (540) | — | 195 | 5.5 | 0.120 |
| Example 37 | 9.4 Dy | 9.4 | 6.5 Sm | 540 | — | 200 | 5.5 | 0.150 |
| Example 38 | 9.4 Dy | 9.4 | 7.5 Sn | 562 | — | 195 | 4.5 | 0.097 |
| Example 39 | 9.6 Dy | 9.4 | 7.2 Ba | 634 | — | 193 | 3.8 | 0.105 |
| Example 40 | 8.9 Dy | 9.4 | 8.9 Nd | 548 | 0.6 Zr | 210 | 7.5 | 0.078 |
| Example 41 | 9.9 Dy | 9.4 | 7.6 Nd | 548 | 1.2 Zr | 237 | 8.9 | 0.085 |
| Example 42 | 9.4 Dy | 9.4 | 8.4 Nd | 548 | 0.5 Sr | 218 | 8.0 | 0.078 |
| Example 43 | 9.3 Dy | 9.4 | 8.7 Nd | 548 | 0.5 Mn | 210 | 7.6 | 0.080 |

MM is a rare-earth admixture (eutectic temperature thereof was evaluated with the lowest Sm)

TABLE 5

| | First element (wt %) | Atomic radius differential between first element and magneium (%) | Second element (wt %) | Eutectic temperature of second element (° C.) | Third element (wt %) | Characteristics in strength at 200° C. 0.2% proof stress (MPa) | Elongation (%) | Entire creep elongation 50 MPa, 100 Hr (%) |
|---|---|---|---|---|---|---|---|---|
| Example 44 | 0.6 Ho | 10.0 | 9.0 Nd | 548 | — | 200 | 8.0 | 0.150 |
| Example 45 | 8.4 Ho | 10.0 | 9.2 Nd | 548 | — | 285 | 6.5 | 0.064 |
| Example 46 | 11.4 Ho | 10.0 | 9.7 Nd | 548 | — | 270 | 4.0 | 0.050 |
| Example 47 | 8.6 Ho | 10.0 | 13.5 Nd | 548 | — | 298 | 2.0 | 0.136 |
| Example 48 | 8.2 Ho | 10.0 | 6.5 Ce | 634 | — | 240 | 4.0 | 0.150 |
| Example 49 | 5.0 Ho | 10.0 | 8.0 MM | (540) | — | 205 | 5.0 | 0.150 |
| Example 50 | 8.1 Ho | 10.0 | 6.5 Sm | 540 | — | 240 | 4.2 | 0.170 |
| Example 51 | 7.9 Ho | 10.0 | 7.5 Sn | 562 | — | 180 | 8.9 | 0.132 |
| Example 52 | 8.3 Ho | 10.0 | 8.8 Nd | 549 | 0.8 Zr | 275 | 6.0 | 0.120 |
| Example 53 | 8.5 Ho | 10.0 | 8.1 Nd | 551 | 0.5 Sr | 270 | 5.0 | 0.090 |
| Example 54 | 8.6 Ho | 10.0 | 8.1 Nd | 552 | 0.6 Mn | 270 | 5.5 | 0.120 |

MM is a rare-earth admixture (eutectic temperature thereof was evaluated with the lowest Sm)

TABLE 6

| | First element (wt %) | Atomic radius differential between first element and magneium (%) | Second element (wt %) | Eutectic temperature of second element (° C.) | Third element (wt %) | Characteristics in strength at 200° C. 0.2% proof stress (MPa) | Elongation (%) | Entire creep elongation 50 MPa, 100 Hr (%) |
|---|---|---|---|---|---|---|---|---|
| Example 55 | 0.4 Y | 13.8 | 9.0 Nd | 548 | — | 100 | 16.5 | 0.165 |
| Example 56 | 2.0 Y | 13.8 | 8.2 Nd | 548 | — | 160 | 8.0 | 0.100 |
| Example 57 | 5.0 Y | 13.8 | 8.0 Nd | 548 | — | 140 | 5.5 | 0.130 |
| Example 58 | 2.0 Y | 13.8 | 14.5 Nd | 548 | — | 220 | 4.3 | 0.145 |
| Example 59 | 1.8 Y | 13.8 | 8.3 Ce | 634 | — | 165 | 5.0 | 0.095 |
| Example 60 | 1.8 Y | 13.8 | 7.0 MM | (540) | — | 160 | 6.5 | 0.190 |
| Example 61 | 1.9 Y | 13.8 | 6.8 Sm | 540 | — | 135 | 11.0 | 0.140 |
| Example 62 | 2.0 Y | 13.8 | 5.0 Sn | 562 | — | 145 | 15.5 | 0.180 |
| Example 63 | 2.0 Y | 13.8 | 8.0 Nd | 549 | 0.4 Zr | 170 | 8.5 | 0.135 |
| Example 64 | 2.0 Y | 13.8 | 8.5 Nd | 551 | 0.2 Sr | 165 | 8.5 | 0.130 |
| Example 65 | 1.9 Y | 13.8 | 5.4 Nd | 552 | 0.5 Mn | 165 | 7.0 | 0.160 |

MM is a rare-earth admixture (eutectic temperature thereof was evaluated with the lowest Sm)

As a result, the magnesium alloys prepared by adding the first, second and third components that each meet the specific conditions (Examples 1 through 65) indicated more advantageous properties than the examples (Comparative examples 1 and 2) where calcium of which the atomic radius is different from that of magnesium by 14% or more was employed, and the examples (Comparative examples 3 through 6) where aluminum, zinc, or the like each having a radius shorter than magnesium atom has. Consequently, the utilities of the magnesium alloys according to the present invention were assured.

Second Working Examples

Next, to prepare a material having the composition as shown in Table 7, pure magnesium was melted in an atmosphere of a mixture of gases consisting of argon and sulfur hexafluoride in an electric smelting furnace, and a first component and a second component each in a predetermined amount were charged, stirred, and rested. The resulting molten metal was poured into a metal mold 30 mm high, 25 mm wide, and 200 mm long, to obtain a casting material.

Misch metal (MM) was used as elements among lanthanoids, within the range from lanthanum through europium.

Moreover, the melting process was carried out in a melting pot of which the inside had been calorized, and the charging of the elements was performed when the temperature of the pure magnesium was 700° C.

The casting material was soaked for 100-hr. thermal hysteresis in an atmosphere at 200° C., and thereafter, a tensile test specimen and a creep test specimen were taken out and subjected to the tensile test and the creep test (both in the form of JIS No. 4 Piece).

The tensile test was conducted using a 5-ton Autograph Tester in an atmosphere at 200° C. at a tensile speed of 0.5 mm/minute. In the creep test, a load of 50 MPa is given at 200° C. for 100 hrs to measure an entire elongation percentage. The results are shown in FIG. 7.

TABLE 7

| | First element (mass %) | Second element (mass %) | Third element (mass %) | Characteristics in strength at 200° C. 0.2% proof stress (MPa) | Elongation on rupture (%) | Entire creep elongation (%) 50 MPa, 100 Hr |
|---|---|---|---|---|---|---|
| Example 66 | 0.8 Gd | 9.5 Nd | — | 120 | 7.5 | 0.150 |
| Example 67 | 3.5 Gd | 8.0 Nd | — | 185 | 8.0 | 0.065 |
| Example 68 | 4.1 Gd | 9.7 Nd | — | 178 | 3.0 | 0.102 |
| Example 69 | 3.4 Gd | 2.4 Nd | — | 84 | 11.5 | 0.240 |
| Example 70 | 3.6 Gd | 13.5 Nd | — | 275 | 4.2 | 0.078 |
| Example 71 | 3.5 Gd | 8.0 Ce | — | 175 | 6.0 | 0.085 |
| Example 72 | 3.5 Gd | 15.0 Ce | — | 265 | 3.0 | 0.095 |
| Example 73 | 1.0 Gd | 8.0 Ce | — | 120 | 7.5 | 0.150 |
| Example 74 | 3.5 Gd | 8.0 La | — | 130 | 8.0 | 0.160 |
| Example 75 | 3.7 Gd | 7.9 Pr | — | 163 | 6.5 | 0.295 |
| Example 76 | 3.5 Gd | 6.5 Sm | — | 140 | 5.4 | 0.362 |
| Example 77 | 3.5 Gd | 8.0 MM | — | 180 | 6.5 | 0.075 |
| Example 78 | 3.7 Gd | 8.5 Nd | 0.4 Zr | 180 | 7.4 | 0.070 |
| Example 79 | 3.6 Gd | 8.9 Nd | 0.8 Zr | 187 | 7.6 | 0.096 |
| Example 80 | 3.7 Gd | 7.6 Nd | 1.2 Zr | 198 | 8.5 | 0.150 |
| Example 81 | 3.5 Gd | 8.4 Nd | 0.5 Sr | 185 | 7.4 | 0.130 |
| Example 82 | 3.5 Gd | 8.7 Nd | 0.7 Mn | 188 | 8.3 | 0.087 |
| Comparative example 9 | 3.5 Gd | — | — | 87 | 22.0 | 1.086 |
| Comparative example 10 | 3.5 Gd | 20.0 Ce | — | 255 | 0.2 | 0.090 |
| Comparative example 11 | 0.5 Ca | 0.8 Si | — | 20 | 23.0 | Ruptured halfway |
| Comparative example 12 | 2.0 Ca | 1.0 Si | — | 45 | 16.5 | 6.950 |
| Comparative example 13 | 2.0 AL | 0.8 Si | — | 70 | 8.5 | Ruptured halfway |
| Comparative example 14 | 4.0 AL | 2.0 Nd | — | 100 | 10.0 | 2.250 |
| Comparative example 15 | 5.0 AL | 3.0 MM | — | 50 | 13.0 | 1.730 |
| Comparative example 16 | 5.0 AL | 3.0 Ca | — | 75 | 6.5 | 0.520 |
| Comparative example 17 | 1.0 Zn | 3.0 Nd | — | 90 | 4.0 | 0.305 |

As can be seen from Table 7, the magnesium alloys prepared by adding the first, second and, if desired, third components that each meet the specific conditions (kinds of elements and amounts thereof) required by the present invention (Examples 66 through 82) indicated more advantageous properties than the examples (Comparative examples 9 and 10) where cerium (Ce) as the second component less than 1 mass % or more than 15 mass % was employed, and the conventional magnesium alloys (Comparative examples 11 through 17). Consequently, excellent properties at high temperatures of the magnesium alloys according to the present invention were assured.

Third Working Examples

Next, to prepare a material having the composition as shown in Table 8, pure magnesium was melted in an atmosphere of a mixture of gases consisting of argon and sulfur hexafluoride in an electric smelting furnace, and a first component and a second component each in a predetermined amount were charged, stirred, and rested. The resulting molten metal was poured into a metal mold 30 mm high, 25 mm wide, and 200 mm long, to obtain a casting material.

The melting process was carried out in a melting pot of which the inside had been calorized, and the charging of the elements was performed when the temperature of the pure magnesium was 700° C.

The casting material was soaked for 100-hr. thermal hysteresis in an atmosphere at 150° C., and thereafter, a tensile test specimen and a creep test specimen were taken out and subjected to the tensile test and the creep test (both in the form of JIS No. 4 Piece).

The tensile test was conducted using a 5-ton Autograph Tester in an atmosphere at 150° C. at a tensile speed of 0.5 mm/minute. In the creep test, a load of 50 MPa is given at 150° C. for 100 hrs to measure an entire elongation percentage.

TABLE 8

| | Compostion of alloy (Unit is mass %) | Cerium/Tin ratio | Characteristics in creep at 200° C. Entire Creep elongation (%) 50 MPa 100 Hr |
|---|---|---|---|
| Example 83 | Mg-5.0Ce-3.6Sn | 1.4 | 0.234 |
| Example 84 | Mg-5.0Ce-4.5Sn | 1.1 | 0.193 |
| Example 85 | Mg-4.5Ce-6.4Sn | 0.7 | 0.245 |
| Example 86 | Mg-8.0Ce-6.2Sn | 1.3 | 0.136 |
| Example 87 | Mg-4.0Ce-4.0Sn | 1.0 | 0.161 |
| Example 88 | Mg-4.0Ce-6.7Sn | 0.6 | 0.185 |
| Example 89 | Mg-6.0Ce-5.0Sn | 1.2 | 0.179 |
| Comparative example 18 | Mg-0.5Ce-1.0Sn | 0.5 | Ruptured halfway |
| Comparative example 19 | Mg-1.0Ce-5.0Sn | 0.2 | Ruptured halfway |
| Comparative example 20 | Mg-5.0Ce-3.3Sn | 1.5 | 0.550 |
| Comparative example 21 | Mg-14.0Ce-7.0Sn | 2.0 | 0.358 |
| Comparative example 22 | Mg-0.5Ca-1.0Si | — | Ruptured halfway |
| Comparative example 23 | Mg-2.0Ca-1.0Si | — | 6.950 |
| Comparative example 24 | Mg-2.0A1-0.8Si | — | Ruptured halfway |
| Comparative example 25 | Mg-4.0A1-2.0Nd | — | 2.250 |
| Comparative example 26 | Mg-5.0A1-3.0MM | — | 1.730 |
| Comparative example 27 | Mg-3.0Nd-1.0Zn | — | 0.305 |
| Comparative example 28 | Mg-5.0A1-3.0Ca | — | 0.520 |
| Comparative example 29 | Mg-5.0A1-2.0Ca-2.0MM | — | 0.755 |

As a result, it has been shown that if the amounts of addition of cerium (Ce) and tin (Sn) in the resulting magnesium alloys each fall within a predetermined range, and if a ratio of addition of cerium (Ce) and tin (Sn) in mass (cerium/tin ratio or Ce/Sn ratio) falls within a range of 0.6 to 1.4 (Examples 83 through 89), the entire creep elongation (%) can be restricted, in comparison with the alloys having conventional compositions (Comparative examples 29 through 36) or the like.

Moreover, when the amount of addition of cerium (Ce) and tin (Sn) were both less than the lower limit (2 mass % and 10 mass % respectively) (Comparative example 25), or when the amount of addition of cerium (Ce) only was less than the lower limit (2 mass %) (Comparative example 26), the magnesium alloys were ruptured halfway during the creep test. It is presumably because the amount of eutectic compounds formed was too small to inhibit deformation of the magnesium alloys.

Further, when the amounts of addition of cerium (Ce) and tin (Sn) each fell within a predetermined range, and if the ratio of addition of cerium (Ce) and tin (Sn) in mass (cerium/tin ratio or Ce/Sn ratio) was out of a range of 0.6 to 1.4 (Example 3), the entire creep elongations (%) were substantially equal to or better than those of the alloys having conventional compositions (Comparative examples 29 through 36).

Therefore, it has been shown that the creep elongation (%) of the magnesium alloys to which cerium (Ce) and tin (Sn) each in a predetermined range of amounts are added shows a better result than those of the magnesium alloys having conventional compositions, and more desirable result can be achieved if the ratio of cerium (Ce) and tin (Sn) to be added falls within a range from 0.6 to 1.4.

Consequently, the utilities of the magnesium alloys according to the present invention were assured.

It is understood that the present invention is not limited to the aforementioned forms of the present invention, but that other forms as follows for example fall within the scope of the present invention.

(First Variation)

(1) A refractory magnesium alloy, which includes magnesium as a principal ingredient, and an element having a radius 9–14% larger than a magnesium atom and a maximum concentration of 2 mass % or larger in a solid solution with magnesium, which element is mixed in an amount not exceeding a maximum amount that can be homogeneously mixed in the solid solution with magnesium, whereby internal strength of grains thereof is enhanced.

(2) A refractory magnesium alloy, which further includes an element having an eutectic temperature of 540° C. with magnesium, which element with a content thereof ranging from 1 to 15 mass % is added.

(3) A structural material for a vehicle which is made up of the above refractory magnesium alloys.

(Second Variation)

(1) A refractory magnesium alloy, which includes magnesium as a principal ingredient, and gadolinium with a content thereof ranging from 0.5 to 3.8 mass %, wherein remaining part other than the gadolinium is composed of the magnesium and unavoidable impurities.

(2) A refractory magnesium alloy, in addition to the above refractory magnesium alloy, further includes at least one element selected from a group consisting of lanthanum through europium among lanthanoids in the periodic table of the elements with a content thereof ranging from 1 to 15 mass %.

(3) A refractory magnesium alloy, in addition to the above refractory magnesium alloy, further includes at least one element selected from a group consisting of zirconium, strontium and manganese with a content thereof falling below 1 mass %.

(4) A structural material for a vehicle which is made up of the above refractory magnesium alloys.

(Third Variation)

(1) A refractory magnesium alloy, which includes magnesium as a principal ingredient, and gadolinium with a content thereof ranging from 0.5 to 3.8 mass %, wherein remaining part other than the gadolinium is composed of the magnesium and unavoidable impurities.

(2) A refractory magnesium alloy, in addition to the above refractory magnesium alloy, further includes at least one element selected from a group consisting of lanthanum through europium among lanthanoids in the periodic table of the elements with a content thereof ranging from 1 to 15 mass %.

(3) A refractory magnesium alloy, in addition to the above refractory magnesium alloy, further includes at least one element selected from a group consisting of zirconium, strontium and manganese with a content thereof falling below 1 mass %.

(4) A structural material for a vehicle which is made up of the above refractory magnesium alloys.

INDUSTRIAL APPLICABILITY

The present invention realizes magnesium alloys that have both of high proof stress and high creep strength at high temperatures, and thus may be employed for reinforcing members to be exposed to high temperature conditions such as engines for a vehicle, so that decrease in axial force in a bolt-fastened portion can be restricted to the minimum, and a significant reduction in weight of a vehicle body can be achieved.

Moreover, the present invention realizes magnesium alloys that have high creep strength at 150° C. or higher, and thus may be employed for reinforcing members to be exposed to high temperature conditions such as engines for a vehicle, so that decrease in axial force in a bolt-fastened portion can be restricted to the minimum, and a significant reduction in weight of a vehicle body can be achieved.

Further, the present invention realizes a casting process of magnesium or magnesium alloys by which magnesium or magnesium alloys may be cast without allowing molten metal of magnesium or magnesium alloys to be oxidized or burnt in the presence of oxygen, and thus makes it easier to cast the magnesium or magnesium alloys than a conventional method of casting magnesium or magnesium alloys while preventing the molten metal of the magnesium or magnesium alloys from being oxidized or burnt.

The invention claimed is:

1. A magnesium alloy consisting of:

cerium from 4.0% to 10.0% by mass and tin from 1.4% to 7.0% by mass; and further consisting of:

zirconium from 0.5% to 1% by mass;

strontium from 0.5% to 1% by mass; or manganese from 0.5% to 1% by mass; the balance being only magnesium and unavoidable impurities.

2. The magnesium alloy of claim 1, wherein the alloy is a structural member for a vehicle.

* * * * *